US009372467B2

(12) United States Patent
Ishida et al.

(10) Patent No.: US 9,372,467 B2
(45) Date of Patent: Jun. 21, 2016

(54) IMAGE FORMING APPARATUS HAVING PHOTORECEPTOR WITH LUBRICANT SUPPLYING PART AND LUBRICANT REMOVAL PART

(71) Applicant: Konica Minolta, Inc., Tokyo (JP)

(72) Inventors: Takeshi Ishida, Hachioji (JP); Masahiko Kurachi, Hino (JP); Hokuto Hatano, Hachioji (JP); Kazunori Kurimoto, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/618,570

(22) Filed: Feb. 10, 2015

(65) Prior Publication Data

US 2015/0234343 A1 Aug. 20, 2015

(30) Foreign Application Priority Data

Feb. 18, 2014 (JP) ..... 2014-028125

(51) Int. Cl.
*G03G 21/00* (2006.01)

(52) U.S. Cl.
CPC ..... *G03G 21/0094* (2013.01); *G03G 21/0076* (2013.01)

(58) Field of Classification Search
USPC ..... 399/107, 110, 123, 343–347
See application file for complete search history.

(56) References Cited

U.S. PATENT DOCUMENTS 7,415,238 B2 * 8/2008 Watanabe et al. ..... 399/350
7,560,209 B2 * 7/2009 Tokutake et al. ..... 430/66

(Continued)

FOREIGN PATENT DOCUMENTS

JP 2007086734 A 4/2007
JP 2008040137 A 2/2008

(Continued)

OTHER PUBLICATIONS

Notification of Reason for Refusal; Patent Application No. 2014-028125; Creation Date: Jan. 7, 2016; Examiner, Patent Office: Takuji Saitou 4637 2C00; Patent Agent: Masahiko Ooi; Dispatch No. 013000; Dispatch Date: Jan. 19, 2016; total of 1 page; English translation of Notification of Reason for Refusal; total of 1 page; Grand Total of 2 pages.

*Primary Examiner* — Hoan Tran
(74) *Attorney, Agent, or Firm* — Lucas & Mercanti, LLP

(57) ABSTRACT

To provide an image forming apparatus that suppresses occurrence of image deletion in a high-temperature and high-humidity environment and provides good toner cleanability. Provided is an image forming apparatus including a photoreceptor having a protective layer containing a crosslinked polymer as a surface layer, wherein, along with the rotation direction of the photoreceptor in the external area of the rotating photoreceptor, a lubricant supplying part that supplies lubricant onto the surface of the photoreceptor, a charging part that charges the surface of the photoreceptor by a charging roller, an exposure part that exposes the charged photoreceptor by the charging part, a developing part that supplies toner to the exposed photoreceptor by the exposure part to form a toner image, a transfer part that transfers the toner image formed on the photoreceptor, a cleaning part that removes the toner remained on the surface of the photoreceptor and a lubricant removing part that removes the lubricant adhered on the surface of the photoreceptor are sequentially disposed.

8 Claims, 4 Drawing Sheets

(56) References Cited

U.S. PATENT DOCUMENTS

| | | | | |
|---|---|---|---|---|
| 7,593,682 | B2 * | 9/2009 | Tokumasu et al. | 399/346 |
| 2011/0052928 | A1 | 3/2011 | Shionoiri et al. | |

FOREIGN PATENT DOCUMENTS

| | | | |
|---|---|---|---|
| JP | 2008-122869 | A | 5/2008 |
| JP | 2011118350 | A | 6/2011 |

* cited by examiner

IMAGE FORMING APPARATUS HAVING PHOTORECEPTOR WITH LUBRICANT SUPPLYING PART AND LUBRICANT REMOVAL PART

CROSS-REFERENCE TO RELATED APPLICATION

This application is based on Japanese Patent Application No. 2014-028125 filed on Feb. 18, 2014, the contents of which are incorporated herein by reference.

TECHNICAL FIELD

The present invention relates to an electrophotographic image forming apparatus.

BACKGROUND ART

Conventionally, in an electrophotographic image forming apparatus, a long lifetime and stability of image quality are required. The lifetime of a photoreceptor that is an important functional member in an image forming apparatus is determined by the degree of abrasion of the photosensitive layer. Also, image quality degradation is caused by the generation of small flaw and abrasion unevenness, an image forming unit including a photoreceptor needs to be replaced.

Recently, a protective layer by a crosslinked cured resin is laminated on the surface of the photoreceptor, thereby improving abrasion resistance, scratch resistance and environmental stability, and prolonging the lifetime.

In addition, recently, as a charging system of a photoreceptor, a roller charging system that is advantageous for better picture and smaller device and can reduce the amount of generation of oxidized gas such as ozone and NOx, as compared to a scorotron/corotron charging system, is adopted. Here, the roller charging system refers to a charging system that charges a photoreceptor by bringing a charging member comprising a charging roller into contact with or closer to the surface of the photoreceptor.

However, the problem is that, when charging is performed by roller charging system, the surface of the photoreceptor is degraded, and the resistance of the surface of the photoreceptor cannot be kept high, thus image deletion occurs in a high-temperature and high-humidity environment.

In addition, the problem is that, when the photoreceptor having a protective layer by a crosslinked cured resin is charged by roller charging system, the rate of degradation on the surface of the photoreceptor is higher than the rate of surface polishing, and the torque is increased by the adhered discharge product, and cleaning failure accompanying warpage or chipping off of a cleaning blade or the like or toner filming is caused.

In order to solve the problems of cleaning failure and toner filming, a method of applying lubricant to the surface of the photoreceptor to form a film of the lubricant on the surface of the photoreceptor and reduce adhesion of the toner is known. This allows the torque of a cleaning blade to be reduced, and cleanability to be improved.

However, in the roller charging system, the problem is that, when charging is repeated, the lubricant is degraded to change into a water-absorbing material, thereby further promoting image deletion in a high-temperature and high-humidity environment.

In order to solve the problem of image deletion by the degraded lubricant, it is necessary to remove the degraded lubricant and then constantly supply new lubricant.

JP-A-2008-122869 describes an image forming apparatus in which a lubricant supplying part is disposed on the upstream side of a cleaning part in the rotation direction of the photoreceptor, and a lubricant removing part that removes powder lubricant by a non-contact electrostatic roller is disposed on the downstream side of a cleaning part and the upstream side of the charging part. However, in this image forming apparatus, the problem is that, the lubricant is not sufficiently laminated before charging by the charging part, thus the surface of the photoreceptor is degraded by charging by the charging part, and the resistance of the surface of the photoreceptor cannot be kept high, thus image deletion occurs in a high-temperature and high-humidity environment.

SUMMARY

The present invention is achieved in view of the problems described above, and an object of the present invention is to provide an image forming apparatus that suppresses occurrence of image deletion in a high-temperature and high-humidity environment and provides good toner cleanability.

To achieve at least one of the abovementioned objects, an image forming apparatus reflecting one aspect of the present invention comprising:

a photoreceptor having a protective layer containing a crosslinked polymer as a surface layer;

a lubricant supplying part that supplies lubricant onto the surface of the photoreceptor, a charging part that charges the surface of the photoreceptor by a charging roller, an exposure part that exposes the charged photoreceptor by the charging part, a developing part that supplies toner to the exposed photoreceptor by the exposure part to form a toner image, a transfer part that transfers the toner image formed on the photoreceptor, a cleaning part that removes the toner remained on the surface of the photoreceptor and a lubricant removing part that removes the lubricant adhered on the surface of the photoreceptor; and wherein, the lubricant supplying part, the charging part, the exposure part, the developing part, the transfer part, the cleaning part and the lubricant removing part are sequentially disposed along with a rotation direction of the photoreceptor in an external area of the rotating photoreceptor.

DESCRIPTION OF EMBODIMENTS

Hereinafter, the present invention will be described in detail.

[Image Forming Apparatus]

Figure 1:
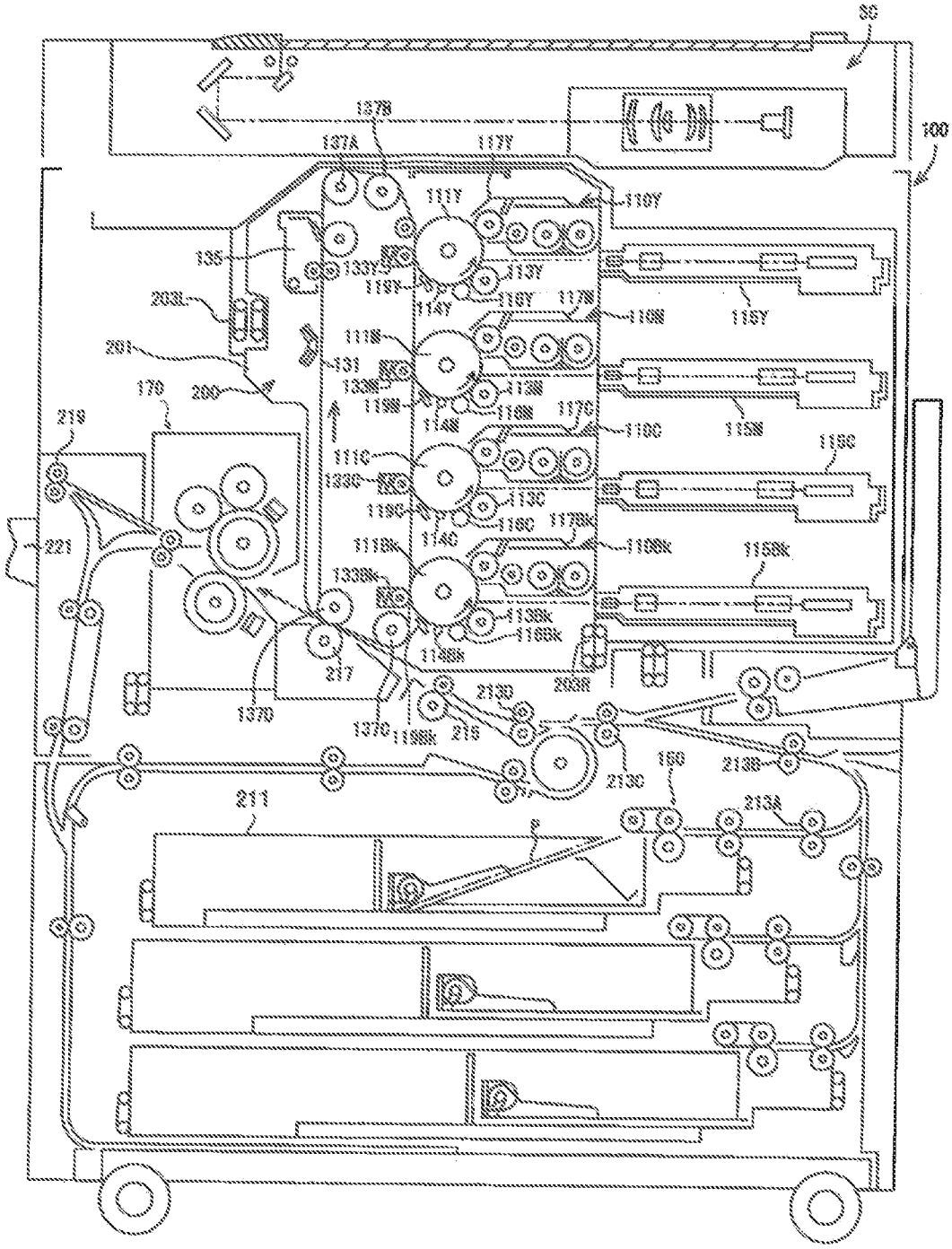
FIG. 1 is an explanatory sectional view of an example of a constitution of the image forming apparatus of the present invention.

FIG. 1 is an explanatory sectional view of an example of a constitution of the image forming apparatus of the present invention.

Image forming apparatus 100 is called as a tandem type color image forming apparatus, and has four image forming units 110Y, 110M, 110C and 110Bk, paper feeding and conveying part 150 and fixing part 170. On the upper part of a body of the image forming apparatus 100, original image reading device SC is disposed.

The image forming units 110Y, 110M, 110C and 110Bk are disposed in the vertical direction. The image forming units 110Y, 110M, 110C and 110Bk have rotating drum-like photoreceptors 111Y, 111M, 111C and 111Bk, and lubricant supplying part 116Y, 116M, 116C and 116Bk, charging part 113Y, 113M, 113C and 113Bk, exposure part 115Y, 115M, 115C and 115Bk, developing part 117Y, 117M, 117C and 117Bk, primary transfer rollers (primary transfer part) 133Y, 133M, 133C and 133Bk, cleaning part 119Y, 119M, 119C and 119Bk and lubricant removing part 114Y, 114M, 114C and 114Bk, sequentially disposed along with the rotation direction of the photoreceptor in the external area of the photoreceptors. On the photoreceptors 111Y, 111M, 111C and 111Bk, toner images of yellow (Y), magenta (M), cyan (C) and black (Bk) are respectively formed. The image forming units 110Y, 110M, 110C and 110Bk are constituted in the same way except that the color of the toner image formed on the photoreceptors 111Y, 111M, 111C and 111Bk is different, thus will be described by an example of the image forming unit 110Y hereinbelow.

According to the image forming apparatus of the present invention, according to the technical feature that new lubricant is supplied after removing lubricant with a charging history, lubricant is supplied on the surface of the photoreceptor by a lubricant supplying part and a film of the lubricant is formed before charging by a charging part, thus degradation of the surface of the photoreceptor can be prevented. The resistance of the surface of the photoreceptor can be kept high, therefore occurrence of image deletion in a high-temperature and high-humidity environment can be suppressed. Also, before removing toner by a cleaning part, lubricant is present on the surface of the photoreceptor, thus good toner cleanability is obtained, and moreover, after removing the toner by the cleaning part, the degraded lubricant is removed from the surface of the photoreceptor by a lubricant removing part, thus occurrence of image deletion accompanying degradation of the lubricant can be also suppressed.

[Photoreceptor]

Photoreceptor 111Y is a drum-like photoreceptor having a protective layer, as a surface layer, containing a crosslinked polymer. The photoreceptor 111Y of this example specifically has a layer constitution in which an intermediate layer on a conductive support and a photosensitive layer obtained by laminating a charge generating layer containing a charge generating substance and a charge transport layer containing a charge transport substance in this order is formed on this intermediate layer, and a protective layer is formed on this photosensitive layer (charge transport layer) as a surface layer. Here, the photosensitive layer may have a layer constitution of a single layer structure containing a charge generating substance and a charge transport substance.

(Polymerizable Compound)

The crosslinked polymer constituting the protective layer is a crosslinked cured resin obtained by polymerizing a polymerizable compound having two or more polymerizable functional groups by irradiation with an active ray such as an ultraviolet light and an electron beam, and forming crosslinking by crosslinking reaction to cure. As the polymerizable compound, a compound having two or more polymerizable functional groups is used, and a compound having one polymerizable functional group can be also used in combination. Specifically, examples of the polymerizable compound include styrenic monomers, acrylic monomers, methacrylic monomers, vinyl toluene monomers, vinyl acetate monomers, N-vinylpyrrolidone monomers, and the like.

As the polymerizable compound, an acrylic monomer having two or more acryloyl groups ($CH_2{=}CHCO{-}$) or methacryloyl groups ($CH_2{=}CCH_3CO{-}$) or an oligomer thereof is particularly preferred because it can be cured by a small amount of light or in a short time.

In the present invention, the polymerizable compound may be used alone or in combination of two or more kinds. Also, as the polymerizable compound, a monomer may be used, and may be oligomerized and used.

Hereinbelow, specific examples of the polymerizable compound are shown.

[Chemical Formula 1]

M1

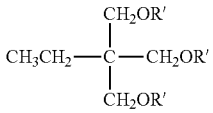

M2

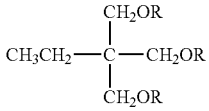

M3

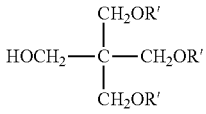

M4

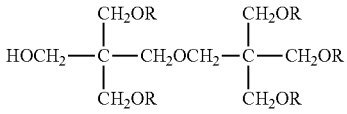

M5

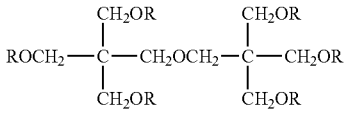

M6

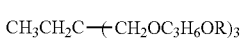

M7

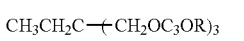

[Chemical Formula 2]

M8

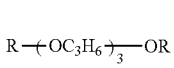

M9

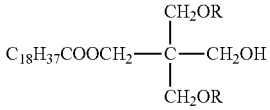

M10

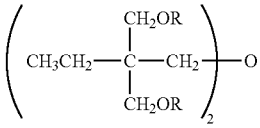

M11

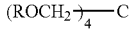

-continued

M12

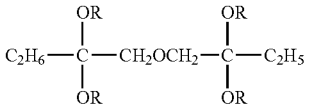

M13

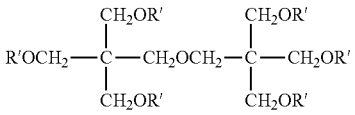

M14

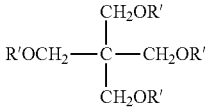

In the chemical formula showing the above exemplified compounds M1 to M14, R represents an acryloyl group ($CH_2{=}CHCO{-}$), and R' represents a methacryloyl group ($CH_2{=}CCH_3CO{-}$).

(Metal Oxide Fine Particles)

In the protective layer, from the viewpoint of film strength and conductivity, metal oxide fine particles may be contained. Also, the metal oxide fine particles are preferably those surface-treated by a surface treatment agent.

As the metal oxide fine particles, for examples, silica (silicon oxide), magnesium oxide, zinc oxide, lead oxide, alumina (aluminum oxide), zirconium oxide, tin oxide, titania (titanium oxide), niobium oxide, molybdenum oxide, vanadium oxide or the like can be used. Among them, from the viewpoint of hardness, conductivity and light permeability, tin oxide is preferred.

The number average primary particle size of the metal oxide fine particles is preferably 1 to 300 nm, more preferably 3 to 100 nm, and further preferably 5 to 40 nm.

In the present invention, magnified pictures at 10,000 magnification were processed by a scanning electron microscope (manufactured by JEOL Ltd.), and randomly scanned picture images of 300 metal oxide fine particles (except for agglomerates) were subjected to an automatic image processing and analysis equipment "LUZEX AP (software version 1.32)" (manufactured by Nireco Corporation) to calculate a number average primary particle diameter of the metal oxide fine particles.

As the surface treatment agent, one that reacts with a hydroxy group present on the surface of the metal oxide fine particles is preferred, and examples of the surface treatment agent described above include silane coupling agents, titanium coupling agents, and the like.

Also, a surface treatment agent having a radically polymerizable reactive group is preferred as the surface treatment agent. Examples of the radically polymerizable reactive group include a vinyl group, an acryloyl group, a methacryloyl group, and the like. The radically polymerizable reactive group described above can react with the polymerizable compound according to the present invention to form a rigid protective layer. As the surface treatment agent having a radically polymerizable reactive group, a silane coupling agent having a radically polymerizable reactive group such as a vinyl group, an acryloyl group or a methacryloyl group is preferred.

Hereinbelow, specific examples of the surface treatment agent are shown.

S-1:$CH_2{=}CHSi(CH_3)(OCH_3)_2$

S-2:$CH_2{=}CHSi(OCH_3)_3$

S-3:$CH_2{=}CHSiCl_3$

S-4:$CH_2{=}CHCOO(CH_2)_2Si(CH_3)(OCH_3)_2$

S-5:$CH_2{=}CHCOO(CH_2)_2Si(OCH_3)_3$

S-6:$CH_2{=}CHCOO(CH_2)_2Si(OC_2H_5)(OCH_3)_2$

S-7:$CH_2{=}CHCOO(CH_2)_3Si(OCH_3)_3$

S-8:$CH_2{=}CHCOO(CH_2)_2Si(CH_3)Cl_2$

S-9:$CH_2{=}CHCOO(CH_2)_2SiCl_3$

S-10:$CH_2{=}CHCOO(CH_2)_3Si(CH_3)Cl_2$

S-11:$CH_2{=}CHCOO(CH_2)_3SiCl_3$

S-12:$CH_2{=}C(CH_3)COO(CH_2)_2Si(CH_3)(OCH_3)_2$

S-13:$CH_2{=}C(CH_3)COO(CH_2)_2Si(OCH_3)_3$

S-14:$CH_2{=}C(CH_3)COO(CH_2)_3Si(CH_3)(OCH_3)_2$

S-15:$CH_2{=}C(CH_3)COO(CH_2)_3Si(OCH_3)_3$

S-16:$CH_2{=}C(CH_3)COO(CH_2)_2Si(CH_3)Cl_2$

S-17:$CH_2{=}C(CH_3)COO(CH_2)_2SiCl_3$

S-18:$CH_2{=}C(CH_3)COO(CH_2)_3Si(CH_3)Cl_2$

S-19:$CH_2{=}C(CH_3)COO(CH_2)_3SiCl_3$

S-20:$CH_2{=}CHSi(C_2H_5)(OCH_3)_2$

S-21:$CH_2{=}C(CH_3)Si(OCH_3)_3$

S-22:$CH_2{=}C(CH_3)Si(OC_2H_5)_3$

S-23:$CH_2{=}CHSi(OCH_3)_3$

S-24:$CH_2{=}C(CH_3)Si(CH_3)(OCH_3)_2$

S-25:$CH_2{=}CHSi(CH_3)Cl_2$

S-26:$CH_2{=}CHCOOSi(OCH_3)_3$

S-27:$CH_2{=}CHCOOSi(OC_2H_5)_3$

S-28:$CH_2{=}C(CH_3)COOSi(OCH_3)_3$

S-29:$CH_2{=}C(CH_3)COOSi(OC_2H_5)_3$

S-30:$CH_2{=}C(CH_3)COO(CH_2)_3Si(OC_2H_5)_3$

S-31:$CH_2{=}CHCOO(CH_2)_2Si(CH_3)_2(OCH_3)$

S-32:$CH_2{=}CHCOO(CH_2)_2Si(CH_3)(OCOCH_3)_2$

S-33:$CH_2{=}CHCOO(CH_2)_2Si(CH_3)(ONHCH_3)_2$

S-34:$CH_2{=}CHCOO(CH_2)_2Si(CH_3)(OC_6H_5)_2$

S-35:$CH_2{=}CHCOO(CH_2)_2Si(C_{10}H_{21})(OCH_3)_2$

S-36:$CH_2{=}CHCOO(CH_2)_2Si(CH_2C_6H_5)(OCH_3)_2$

The surface treatment agent may be used alone or in combination of two or more kinds.

The amount of the surface treatment agent to be used is preferably 0.1 to 200 parts by mass and more preferably 7 to 70 parts by mass, based on 100 parts by mass of the untreated metal oxide fine particles.

Examples of the method for treating the untreated metal oxide fine particles with the surface treatment agent include a method of wet-cracking a slurry (suspension of solid particles) containing the untreated metal oxide fine particles and the surface treatment agent. According to this method, re-aggregation of the untreated metal oxide fine particles is prevented and also the surface treatment of the untreated metal oxide fine particles is promoted. Thereafter, the solvent is removed, and the metal oxide fine particles are powdered.

The content ratio of the metal oxide fine particles in the protective layer is preferably 20 to 170 parts by mass and more preferably 25 to 130 parts by mass, based on 100 parts by mass of the crosslinked polymer.

In the protective layer, components other than the crosslinked polymer and the metal oxide fine particles may be contained, and for example, various antioxidants can be contained, and various lubricant particles can be also added. For example, fluorine atom-containing resin particles can be added. As the fluorine atom-containing resin particles, it is preferred to properly select one or two or more types from a tetrafluoroethylene resin, a trifluorochloroethylene resin, a hexafluorochloroethylenepropylene resin, a fluorovinyl resin, a fluorovinylidene resin, a difluorodichloroethylene resin and their copolymers, and a tetrafluoroethylene resin and a fluorovinylidene resin are particularly preferred.

The protective layer can be formed by preparing a coating liquid by adding the polymerizable compound, the metal oxide fine particles and a polymerization initiator, and other components as necessary, to a known solvent, applying this coating liquid to the outer peripheral surface of the photosensitive layer (charge transport layer) to form a coating film, drying this coating film, and irradiating it with an active ray such as an ultraviolet light and an electron beam, thereby polymerizing and curing the polymerizable compound component in the coating film.

The protective layer as described above is formed as a crosslinked cured resin, due to the progress of reaction between the polymerizable compounds or the like.

As the solvent used in the formation of the protective layer, any solvent can be used as long as it can dissolve or disperse the polymerizable compound and the metal oxide fine particles, and examples of such solvents include methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, diethylamine and the like, but are not limited to these solvents.

Examples of the method for coating a coating liquid for forming a protective layer include known methods such as a dip coating method, a spray coating method, a spinner coating method, a bead coating method, a blade coating method, a beam coating method, a slide hopper method, and a circular slide hopper method.

The coating film may be subjected to a curing treatment without being dried, but it is preferred to be subjected to a curing treatment after being naturally or thermally dried.

Drying conditions can be properly selected depending on the kind of solvent, film thickness or the like. The drying temperature is preferably from room temperature to 180° C. and more preferably from 80 to 140° C. The drying time is preferably from 1 to 200 min., and particularly preferably from 5 to 100 min.

The method for reacting a polymerizable compound includes a method of reacting by electron beam cleavage and a method of reacting by light or heat by adding a radical polymerization initiator. Either a photopolymerization initiator or a thermal polymerization initiator can be employed as a radical polymerization initiator. Also, the photopolymerization initiator and the thermal polymerization initiator can be employed in combination.

Examples of the thermal polymerization initiator include azo compounds such as 2,2'-azobisisobutyronitrile, 2,2'-azobis(2,4-dimethyl azobisvaleronitrile) and 2,2'-azobis(2-methylbutyronitrile); peroxides such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide and lauroyl peroxide, and the like.

Examples of the photopolymerization initiator include acetophenone or ketal photopolymerization initiators such as diethoxyacetophenone, 2,2-dimethoxy-1,2-diphenylethan-1-one, 1-hydroxy-cyclohexyl-phenyl-ketone, 4-(2-hydroxyethoxyl)phenyl-(2-hydroxy-2-propyl)ketone, 2-benzyl-2-dimethylamino-1-(4-morpholinophenyl)butanone-1 ("Irgacure 369": manufactured by BASF Japan Ltd.), 2-hydroxy-2-methyl-1-phenylpropan-1-one, 2-methyl-2-morpholino(4-methylthiophenyl)propan-1-one and 1-phenyl-1,2-propanedione-2-(o-ethoxycarbonyl)oxime; benzoin ether photopolymerization initiators such as benzoin, benzoin methyl ether, benzoin ethyl ether, benzoin isobutyl ether and benzoin isopropyl ether; benzophenone-based photopolymerization initiators such as benzophenone, 4-hydroxybenzophenone, methyl o-benzoylbenzoate, 2-benzoylnaphthalene, 4-benzoylbiphenyl, 4-benzoylphenylether, acrylated benzophenone and 1,4-benzoylbenzene; thioxanthone-based photopolymerization initiators such as 2-isopropylthioxanthone, 2-chlorothioxanthone, 2,4-dimethylthioxanthone, 2,4-diethylthioxanthone and 2,4-dichlorothioxanthone, and the like.

Examples of other photopolymerization initiator include ethylanthraquinone, 2,4,6-trimethylbenzoyl diphenylphosphine oxide, 2,4,6-trimethylbenzoyl phenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenyl glyoxylate, 9,10-phenanthrene, acridine-based compounds, triazine-based compounds, imidazol-based compounds, and the like. Also, a photopolymerization promoter having a photopolymerization promoting effect can be used alone or in combination with the photopolymerization initiator. Examples of the photopolymerization promoter include triethanolamine, methyldiethanolamine, ethyl 4-dimethylaminobenzoate, isoamyl 4-dimethylaminobenzoate, ethyl(2-dimethylamino)benzoate, 4,4'-dimethylaminobenzophenone, and the like.

As the radical polymerization initiator, a photopolymerization initiator is preferred, and among them, an alkylphenone compound or a phosphine oxide compound is preferred. Particularly, a compound having an α-aminoalkylphenone structure or an acylphosphine oxide structure is preferred.

The polymerization initiator may be used alone or in combination of two or more kinds.

The ratio of the polymerization initiator to be added is preferably 0.1 to 20 parts by mass and more preferably 0.5 to 10 parts by mass, based on 100 parts by mass of the polymerizable compound.

The crosslinked polymer is produced by irradiating a coating film containing the polymerizable compound with an active ray to generate radicals for polymerization, and forming crosslinking bonds via intermolecular and intramolecular crosslinking reaction to make the polymer cured. As the active ray, ultraviolet light and electron beams are more preferred, and ultraviolet light is easy to use and is particularly preferred.

As the light source for ultraviolet light, any light source which generates ultraviolet light can be used without limitation. For example, a low pressure mercury lamp, a medium pressure mercury lamp, a high pressure mercury lamp, an ultrahigh pressure mercury lamp, a carbon arc lamp, a metal halide lamp, xenon lamp, flash (pulse) xenon and the like can be used.

The irradiation conditions vary depending on the individual lamp. The irradiation dose of an active ray is usually from 5 to 500 mJ/cm$^2$, and preferably from 5 to 100 mJ/cm$^2$.

The electric power of the lamp is preferably from 0.1 to 5 kW, and particularly preferably from 0.5 to 3 kW.

As the electron beam source, an electron beam irradiation apparatus is not particularly limited. In general, an electron beam accelerator of a curtain beam system capable of producing high power at relatively low cost is effectively used for such electron beam irradiation. The acceleration voltage during electron beam irradiation is preferably kept in the range of 100 to 300 kV. The absorbed dose is preferably kept in the range of 0.5 to 10 Mrad.

The irradiation time to obtain the required irradiation dose of an active ray is preferably from 0.1 sec to 10 min and more preferably from 0.1 sec to 5 min from the viewpoint of work efficiency.

In the step of forming a protective layer, drying can be performed before and after irradiation with an active ray, and during irradiation with an active ray, and the timing of drying can be properly selected by combining these timings.

The universal hardness of the protective layer is preferably 280 N/mm$^2$ or more and 600 N/mm$^2$ or less and more preferably 500 N/mm$^2$ or more and 600 N/mm$^2$ or less.

In the image forming apparatus of the present invention, it is preferred that the protective layer in the photoreceptor has a universal hardness of 280 N/mm$^2$ or more and 600 N/mm$^2$ or less.

The universal hardness of the protective layer is within the above range, whereby the surface of the photoreceptor has high abrasion resistance, thus the abrasive force of the lubricant removing part described below can be increased, and lubricant removing ability is improved. Therefore, the value of lubricant abundance ratio B is reduced, thus the replacement rate of the lubricant is increased, and occurrence of image deletion accompanying degraded lubricant can be more surely suppressed.

In the present invention, the universal hardness of the protective layer is the value measured by an ultramicrohardness tester "Fischer scope H100" (manufactured by Fischer Instruments).

Specifically, the universal hardness is obtained by the following formula (1) from indentation depth h and load F when the surface of the photoreceptor is pushed into a diamond square pyramidal Vickers indenter by applying load F using test load with a "Fischer scope H100".

$$HU\ (\text{Universal Hardness}) = F/(26.45 \times h^2) \qquad \text{Formula (1)}$$

Here, the universal hardness of the protective layer can be controlled by curing conditions (irradiation time of active ray and active ray type) when forming a protective layer and the type of the polymerizable compound.

The layer thickness of the protective layer is preferably 0.2 to 10 μm and more preferably 0.5 to 6 μm.

In the photoreceptor of the present invention, various known layers can be adopted as a layer other than the protective layer.

[Lubricant Supplying Part]

Lubricant supplying part 116Y is a part that supplies lubricant onto the surface of the photoreceptor 111Y. According to the lubricant supplying part 116Y, a film of the lubricant is formed on the surface of the photoreceptor 111Y. The lubricant supplying part 116Y is disposed on the downstream of lubricant removing part 114Y and on the upstream of charging part 113Y in the rotation direction of the photoreceptor 111Y.

Figure 2:
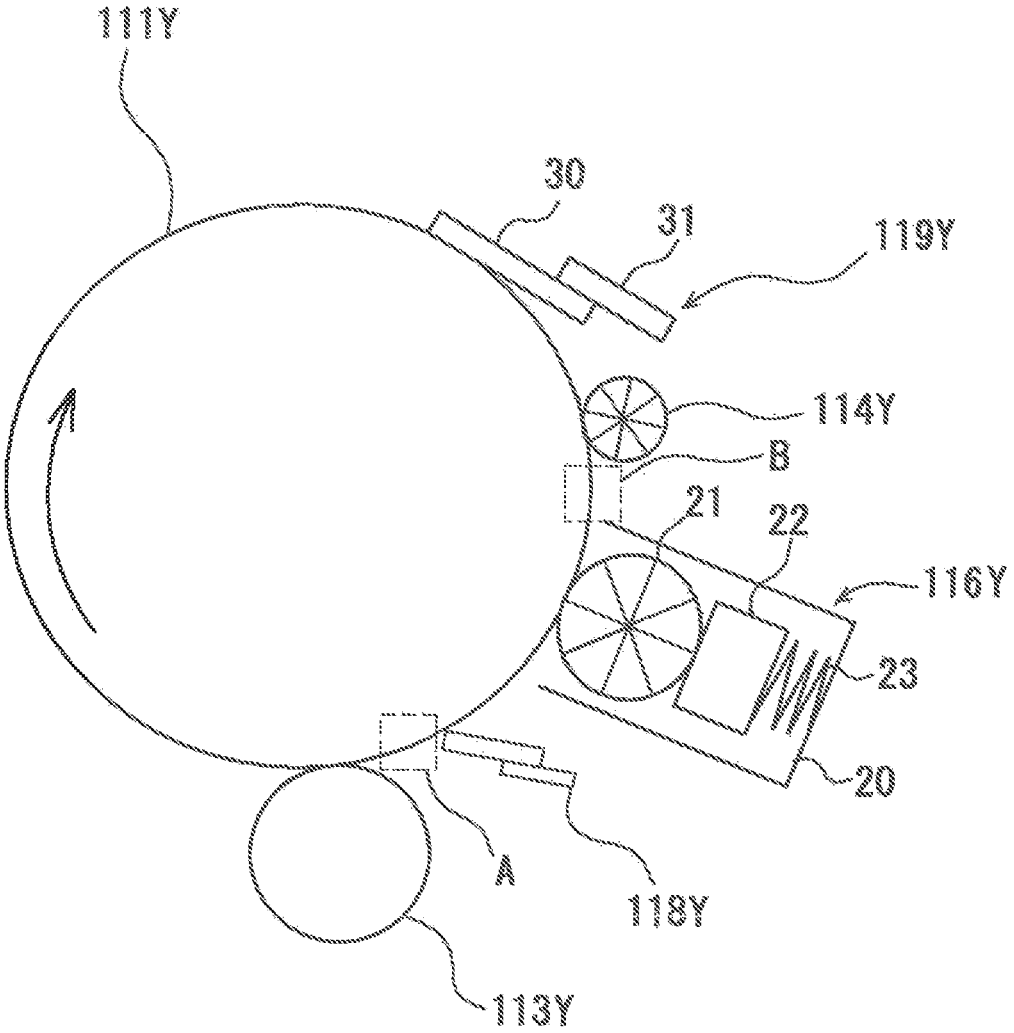
FIG. 2 is an explanatory sectional view of an example of a constitution of a main part of the image forming apparatus of the present invention.

The lubricant supplying part 116Y of this example is constituted by a solid lubricant and a coating member of a brush roller. Specifically, as depicted in FIG. 2, the lubricant supplying part 116Y is constituted by housing 20, and lubricant stock 22 constituted by a rectangular parallelepiped solid lubricant, brush roller 21 that is in contact with the surface of the photoreceptor 111Y, scrapes the lubricant by rubbing the surface of the lubricant stock 22 and applies the lubricant scraped to the surface of the photoreceptor 111Y, pressure spring 23 that presses the lubricant stock 22 against the brush roller 21 and a drive mechanism (not depicted) that rotationally drives the brush roller 21, that are stored in the housing 20. The brush roller 21 is in contact with the surface of the photoreceptor 111Y at the tip of the brush. Also, the brush roller 21 is rotationally driven at the same speed in a opposite direction to the rotation direction of the photoreceptor 111Y.

Examples of the brush roller 21 include those obtained by making a pile-woven fabric in which pile yarn made from a bundle of fibers is woven into a base fabric, into a pile ribbon-like fabric, spirally winding the fabric around a metal shaft with its raised side outside, and adhering the fabric. The brush roller 21 of this example is, for example, one in which a long woven fabric obtained by densely planting a brush fiber made of a resin such as polypropylene is formed on the peripheral surface of the roller base.

As brush bristle, a straight type that raises in a vertical direction to the metal shaft is preferred, from the viewpoint of application capability. The yarn used in the brush bristle is desirably a filament yarn, and the material includes synthetic resins such as 6-nylon, 12-nylon, polyester, acryl and vinylon, and those having a metal such as carbon or nickel incorporated therein for the purpose of enhancing conductivity may be used. For example, it is preferred that the thickness of the brush fiber is 3 to 7 denier, the length of the brush fiber is 2 to 5 mm, the electrical resistivity of the brush fiber is $1\times10^{10}\Omega$ or less, the Young's modulus of the brush fiber is 4900 to 9800 N/mm$^2$, and the planting density of the brush fiber (the number of the brush fiber per unit area) is in the range of 50 k to 200 kF/inch$^2$. The biting amount of the brush roller 21 into the photoreceptor is preferably from 0.5 to 1.5 mm. The rotation speed of the brush roller is, for example, a ratio of 0.3 to 1.5 of the peripheral speed of the photoreceptor, and it may be the rotation in the same direction as the rotation direction of the photoreceptor or the rotation in the opposite direction.

As the pressure spring 23, one pressing in the direction approaching the lubricant stock 22 to the photoreceptor 111Y is used, such that the pressing force of the brush roller 21 to the photoreceptor 111Y is, for example, 0.5 to 1.0 N.

In the lubricant supplying part 116Y, for example, the pressing force of the lubricant stock 22 to the brush roller 21 and the rotation speed of the brush roller 21 are adjusted, such that the application amount per 1 cm$^2$ of the surface of the photoreceptor 111Y is $0.5\times10^{-7}$ to $1.5\times10^{-7}$ g/cm$^2$.

As the lubricant, for example, fatty acid metal salts such as zinc oleate, zinc stearate and calcium stearate can be used. Among them, zinc stearate is preferred from the viewpoint of lubricity and spreadability.

In the image forming apparatus of the present invention, it is preferred that the lubricant is zinc stearate.

[Charging Part]

Charging part 113Y is a part that charges the surface of the photoreceptor 111Y by a charging roller. The charging part 113Y of this example contains a charging roller disposed in contact with the surface of the photoreceptor 111Y and a power source that applies a voltage to the charging roller.

In the present invention, the charging part is according to a proximity charging system to charge in a state that the charging roller is brought into contact with or close to the surface of the photoreceptor.

Figure 3:
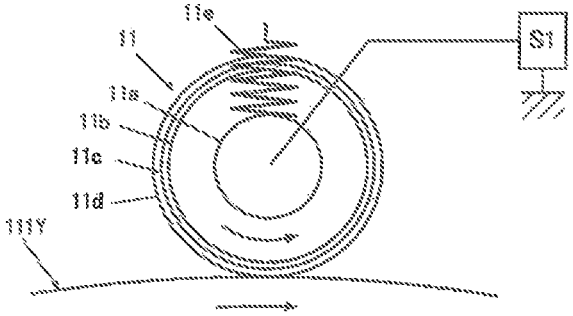
FIG. 3 is an explanatory sectional view of an example of a constitution of a charging part in the image forming apparatus of the present invention.

Charging roller 11 is constituted such that, as depicted in FIG. 3: on the surface of metal core 11*a*, elastic layer 11*b* for reducing charging noise and also providing elasticity to obtain uniform adhesion to the photoreceptor 111Y is laminated, on the surface of the elastic layer 11*b*, resistance control layer 11*c* to make the charging roller 11 have highly uniform electrical resistance as a whole as necessary is laminated; and one on which the surface layer 11*d* is laminated on the resistance control layer 11*c* is urged to a direction of the photoreceptor 111Y by pressing spring 11*e* and pressed to the surface of the photoreceptor 111Y by a predetermined pressing force to form a charging nip part; and the charging roller 11 is rotated following the rotation of the photoreceptor 111Y.

The core metal 11*a* is made of, for example, a metal such as iron, copper, stainless, aluminum or nickel or one obtained by plating the surface of these metals, in a range without impairing conductivity for obtaining rust preventive property and anti-injuring property, and the external diameter thereof is 3 to 20 mm.

The elastic layer 11*b* is, for example, made of one obtained by adding conductive fine particles made of carbon black, carbon graphite and the like, conductive base fine particle made of alkali metal salt, ammonium salt and the like, to an elastic material such as a rubber. Specific examples of the elastic material include natural rubber, synthetic rubber such as ethylene propylene diene methylene rubber (EPDM), styrene-butadiene rubber (SBR), silicone rubber, urethane rubber, epichlorohydrin rubber, isoprene rubber (IR), butadiene rubber (BR), nitrile-butadiene (NBR) and chloroprene rubber (CR), resins such as a polyamide resin, a polyurethane resin, a silicone resin and a fluorine resin, foam such as foamed sponge and the like. The elasticity can be adjusted by adding a process oil, a plasticizer or the like to the elastic material.

It is preferred that the elastic layer 11*b* has a volume resistivity in the range of $1\times10^{1}$ to $1\times10^{10}$ Ω·cm. Also, the layer thickness thereof is preferably 500 to 5000 μm and more preferably 500 to 3000 μm.

The volume resistivity of the elastic layer 11*b* is a value measured according to JIS K 6911.

The resistance control layer 11*c* is provided for the purpose of having uniform electric resistance as the whole charging roller 11 and the like, but may not be provided. This resistance control layer 11*c* can be provided by coating a material having a moderate conductivity, or being coated with a tube having a moderate conductivity.

Specific examples of the material constituting this resistance control layer 11*c* include materials obtained by adding a conductive agent such as conductive fine particles made of carbon black, carbon graphite and the like; conductive metal oxide fine particles made of conductive titanium oxide, conductive zinc oxide, conductive tin oxide and the like; conductive base fine particle made of alkali metal salt, ammonium salt and the like or the like, to a base material such as resins such as a polyamide resin, a polyurethane resin, a fluorine resin and a silicone resin; rubber such as epichlorohydrin rubber, urethane rubber, chloroprene rubber and acrylonitrile rubber.

The resistance control layer 11*c* has a volume resistivity in the range of preferably $1\times10^{-2}$ to $1\times10^{14}$ Ω·cm and more preferably $1\times10^{1}$ to $1\times10^{10}$ Ω·cm. Also, the layer thickness thereof is preferably 0.5 to 100 μm, more preferably 1 to 50 μm, and further preferably 1 to 20 μm.

The volume resistivity of the resistance control layer 11*c* is a value measured according to JIS K 6911.

The surface layer 11*d* is provided for the purpose of preventing a bleedout of the plasticizer or the like in the elastic layer 11*b* to the surface of the charging roller, for the purpose of obtaining slidability or smoothness of the surface of the charging roller, for the purpose of preventing occurrence of leakage even when there is an defect such as pinhole on the photoreceptor 10 or the like, and is provided by coating a material having a moderate conductivity, or covering with a tube having a moderate conductivity.

When the surface layer 11*d* is provided by coating of the material, specific material includes materials obtained by adding a conductive agent such as conductive fine particles made of carbon black, carbon graphite and the like; or conductive metal oxide fine particles made of conductive titanium oxide, conductive zinc oxide, conductive tin oxide and the like, to a base material such as resins such as a polyamide resin, a polyurethane resin, an acrylic resin, a fluorine resin and a silicone resin, epichlorohydrin rubber, urethane rubber, chloroprene rubber, acrylonitrile-based rubber and the like. The coating method includes a dip coating method, a roll coating method, a spray coating method, and the like.

In addition, when the surface layer 11*d* is provided by covering with a tube, specific tube includes tubes obtained by adding the above-described conductive agent nylon 12, a tetrafluoroethylene-perfluoalkylvinylether copolymer resin (PFA), polyvinylidene fluoride, a tetrafluoroethylene-hexafluoropropylene copolymer resin (FEP); polystyrene-based, polyolefin-based, polyvinyl chloride-based, polyurethane-based, polyester-based and polyamide-based thermoplastic elastomers or the like. This tube may be heat shrinkable or non-heat shrinkable.

The surface layer 11*d* has a volume resistivity in the range of preferably $1\times10^{1}$ to $1\times10^{8}$ Ω·cm and more preferably $1\times10^{1}$ to $1\times10^{5}$ Ω·cm. Also, the layer thickness thereof is preferably 0.5 to 100 μm, more preferably 1 to 50 μm, and further preferably 1 to 20 μm.

The volume resistivity of the surface layer 11*d* is a value measured according to JIS K 6911.

Also, the surface layer 11*d* has a surface roughness Rz of preferably 1 to 30 μm, more preferably 2 to 20 μm, and further preferably 5 to 10 μm.

In the charging roller 11 as described above, charging bias voltage is applied to core metal 11*a* of the charging roller 11 by power source S1, whereby the surface of the photoreceptor 111Y is charged to a predetermined potential of a predetermined polarity. Here, the charging bias voltage may be, for example, only DC voltage, and vibration voltage in which AC voltage is superimposed on DC voltage is preferred because it is excellent in charging uniformity.

For example, the charging bias voltage can be set to about −2.5 to −1.5 kV.

An example of charging conditions of charging roller depicted in FIG. 3 is a sine wave with a DC voltage (Vdc) forming the charging bias voltage of −500 V, a AC voltage (Vac) of a frequency of 1000 Hz and a peak-to-peak voltage of 1300 V, and this charging bias voltage is applied, whereby the surface of the photoreceptor 10 is uniformly charged to −500 V.

[Exposure Part]

Exposure part 115Y is a part that exposes the surface of the photoreceptor 111Y provided with uniform potential by the charging part 113Y, based on the image signal (image signal of yellow), to form an electrostatic latent image corresponding to the image of yellow. As the exposure part 115Y, one constituted by an LED in which light-emitting elements are arranged in an array in the axial direction of the photoreceptor 111Y and imaging elements, a laser optic system or the like is used.

[Developing Part]

The developing part 117Y is a part that supplies toner to the surface of the photoreceptor 111Y and develop the electrostatic latent image formed on the surface of the photoreceptor 111Y to form a toner image. The developing part 117Y of this example is specifically constituted by a developing sleeve incorporating a magnet to hold a developer and rotating, and a voltage application device applying DC and/or AC bias voltage between the photoreceptor and this developing sleeve.

[Transfer Part]

The primary transfer roller 133Y constituting the transfer part is a part that transfers the toner image formed on the photoreceptor 111Y to an endless belt-shaped intermediate transfer body 131. The primary transfer roller 133Y is disposed in contact with the intermediate transfer body 131.

In this image forming apparatus 100, an intermediate transfer system that transfers the toner images formed on photoreceptors 111Y, 111M, 111C and 111Bk to the intermediate transfer body 131 by the primary transfer rollers (primary transfer part) 133Y, 133M, 133C and 133Bk and transfers each toner image transferred on the intermediate transfer body 131 to transferring material P by a secondary transfer roller (secondary transfer part) 217 is adopted, but a direct transfer system that transfers the toner images formed on the photoreceptors directly to a transferring material by the transfer part may be adopted.

[Cleaning Part]

Cleaning part 119Y is a part that removes the toner remained on the surface of the photoreceptor 111Y. The cleaning part 119Y of this example is constituted by a cleaning blade. As depicted in FIG. 2, this cleaning blade is constituted by support member 31 and blade member 30 supported via an adhesion layer (not depicted) on this support member 31. The blade member 30 is disposed so that its tip is directed in the direction opposite (counter direction) to the rotation direction of the photoreceptor 111Y in the contacting part with the surface of the photoreceptor 111Y.

The support member 31 is not particularly limited, and a conventionally known one can be used. Examples include those manufactured from rigid metals, metals having elasticity, plastic, ceramic, and the like. Among them, a rigid metal is preferred.

As the blade member 30, for example, one having a multilayer structure obtained by laminating a base layer and an edge layer can be used. It is preferred that the base layer and the edge layer are each constituted by polyurethane. The polyurethane includes polyol, polyisocyanate, and those obtained by reacting with a crosslinking agent as necessary.

[Lubricant Removing Part]

Lubricant removing part 114Y is a part that removes the lubricant adhered to the surface of the photoreceptor 111Y. The lubricant removing part 114Y is disposed on the downstream of cleaning part 119Y and on the upstream of lubricant supplying part 116Y in the rotation direction of the photoreceptor 111Y.

The lubricant removing part 114Y is preferably a part in which a removal member contacts with the surface of the photoreceptor 111Y to remove the lubricant by mechanical action. Here, to remove the lubricant by mechanical action refers to removal of the lubricant by mechanically rubbing the surface of the photoreceptor or the like. As the lubricant removing part, the removal member such as a brush roller or a foamed roller can be used, and the brush roller is preferred from the viewpoint of removing capability and durability. In the image forming apparatus according to the present invention, it is preferred that the lubricant removing part is a brush roller or a foamed roller. Furthermore, in the image forming apparatus according to the present invention, it is preferred that the lubricant removing part is a brush roller. The lubricant removing part 114Y of this example is specifically constituted by a removal member made of a brush roller that is in contact with the surface of the photoreceptor 111Y and is rotationally driven at the same speed in an opposite direction to the rotation direction of the photoreceptor 111Y and a drive mechanism.

Examples of the brush roller as the removing member include those obtained by making a pile-woven fabric in which the pile yarn made of a bundle of fibers is woven into a base fabric into a pile ribbon-like fabric, spirally winding the fabric around a metal shaft with its raised side outside, and adhering to the fabric. The brush roller of this example is, for example, one in which a long woven fabric obtained by densely planting a brush fiber made of a resin such as polyester is formed on the peripheral surface of the metal shaft.

As brush bristle, a straight type that rises in a vertical direction to the metal shaft is preferred from the viewpoint of removing capability. The yarn used in the brush bristle is desirably a filament yarn, and the material includes synthetic resins such as 6-nylon, 12-nylon, polyester, acryl and vinylon, and those having a metal such as carbon or nickel incorporated therein for the purpose of enhancing conductivity may be used. The thickness of the brush fiber is preferably 3 to 15 denier, and the length of the brush fiber is preferably is 2 to 5 mm. In addition, the planting density of the brush fiber is set in the range of 40 k to 500 kF/inch$^2$, whereby it is possible to secure the rigidity required for removal and also prevent uneven removal of the lubricant without making a low density part in the brush bristle. The electrical resistivity of the brush fiber is preferably $1\times10^7\Omega$ or less, and the Young's modulus of the brush fiber is preferably 1500 to 9800 N/mm$^2$. The biting amount of the brush roller into the photoreceptor is preferably from 0.5 to 1.5 mm. The rotation speed of the brush roller is, for example, a ratio of 0.3 to 1.5 of the photoreceptor speed, and it may be the rotation in the same direction as the rotation direction of the photoreceptor or the rotation in the reverse direction.

In the constitution depicted in FIG. 2, leveling blade 118Y that uniformly applies the lubricant supplied to the surface of the photoreceptor 111Y by the lubricant supplying part 116Y is provided on the downstream of the lubricant supplying part 116Y and on the upstream of the charging part 113Y.

In the image forming apparatus 100 of the present invention, as depicted in FIG. 2, it is preferred that, when a lubricant abundance ratio per unit area of the surface of the photoreceptor 111Y after supplying lubricant by the lubricant supplying part 116Y and before charging by the charging part 113Y is referred to A (atm %) and a lubricant abundance ratio per unit area of the surface of the photoreceptor 111Y after removing the lubricant by the lubricant removing part 114Y and before supplying lubricant by the lubricant supplying part 116Y is referred to B (atm %), the following formula (1) and formula (2) are satisfied.

$$A \geq 8B \quad \text{Formula (1)}$$

$$A \geq 1.7 \quad \text{Formula (2)}$$

In the image forming apparatus of the present invention, it is preferred that when a lubricant abundance ratio per unit area of the surface of the photoreceptor after supplying lubricant by the lubricant supplying part and before charging by the charging part is referred to A (atm %) and a lubricant abundance ratio per unit area of the surface of the photoreceptor after removing the lubricant by the lubricant removing part and before supplying lubricant by the lubricant supplying part is referred to B (atm %), A≥8B and A≥1.7 are satisfied.

By satisfying both the above formula (1) and formula (2), before charging by charging part 113Y, lubricant is sufficiently present on the surface of the photoreceptor 111Y, thus degradation of the surface of the photoreceptor 111Y can be prevented and resistance of the surface of the photoreceptor 111Y can be kept high, therefore occurrence of image deletion in a high-temperature and high-humidity environment can be more surely suppressed. Also, before removing the toner by cleaning part 119Y, since lubricant is sufficiently present on the surface of the photoreceptor 111Y, good toner cleanability is surely obtained. Furthermore, after removing the toner by cleaning part 119Y, since the degraded lubricant is removed from the surface of the photoreceptor 111Y, occurrence of image deletion accompanying degradation of the lubricant can be more surely suppressed.

In the measurement of the lubricant abundance ratio A, in the rotating photoreceptor 111Y, an arbitrary position on the surface of the photoreceptor 111Y on the downstream of the lubricant supplying part 116Y and on the upstream of the charging part 113Y can be selected. An arbitrary position on the surface of the photoreceptor 111Y on the downstream of the leveling blade 118Y and on the upstream of the charging part 113Y is particularly preferred.

Also, in the measurement of the lubricant abundance ratio B, in the rotating photoreceptor 111Y, an arbitrary position on the surface of the photoreceptor 111Y on the downstream of the lubricant removing part 114Y and on the upstream of the lubricant supplying part 116Y can be selected.

The lubricant abundance ratio A is 1.7 atm % or more and more preferably 2.0 to 2.5 atm %. The image forming apparatus according to the present invention, it is preferred that the lubricant abundance ratio A is 2.0 to 2.5 atm %. Also, A/B is 8 or more and more preferably 20 to 30. The image forming apparatus according to the present invention, it is preferred that a ratio of the lubricant abundance ratio A to the lubricant abundance ratio B, A/B is 20 to 30.

Here, the lubricant abundance ratio refers to a degree of the presence of lubricant per unit area of the surface of the photoreceptor. In the present invention, the abundance ratio of the metal originating from the lubricant (fatty acid metal salt) on the surface of the photoreceptor measured by X-ray photoelectron spectroscopy (ESCA) is used as the substitution amount. The unit is "atom %". The selective elements to be detected are (1) elements of the crosslinked polymer constituting the protective layer (C, O, etc.), (2) metal oxides (e.g., Sn, etc.), and (3) metals originating from the lubricant (fatty acid metal salt) to be supplied to the surface of the photoreceptor (e.g., Zn, Al, etc.). It is necessary to extract all of elements to be present on the surface of the photoreceptor for these selective elements, depending on the type of the material constituting the protective layer and the type of the used lubricant. Here, for the differentiation between the metal originating from metal oxide and the metal originating from the lubricant contained in the protective layer, kinds different from each other for the used metal oxide and the lubricant metal are selected, from the viewpoint of detectability.

Specifically, only a protective layer is cut out into a 5 mm square from the photoreceptor after printing 2000 sheets, in a high-temperature and high-humidity environment (temperature of 30° C., a humidity of 80% RH), and is used as a measurement sample. The selected elements are quantitatively analyzed under the following measurement conditions, using an X-ray photoelectron spectrometer "K-Alpha" (manufactured by Thermo Fisher Scientific Inc.), and the surface element concentration is calculated from each atomic peak area using relative sensitivity factors. The measured amount of the metal to be detected is regarded as the substitution amount.

Measurement Conditions
X-ray: Al monochromatic ray source
Acceleration: 12 kV, 6 mA
Resolution: 50 eV
Beam system: 400 μm
Step size: 0.1 eV The lubricant abundance ratio A can be controlled by the supply amount of the lubricant in the lubricant supplying part and the pressing force of the lubricant supplying part (for example, the biting amount of the brush roller into the photoreceptor, etc.). Also, the lubricant abundance ratio B can be controlled by the pressing force of the lubricant removing member (for example, the biting amount of the brush roller into the photoreceptor, etc.) and the planting density of the brush fiber of the lubricant removing member.

The intermediate transfer body 131 is wound by a plurality of rollers 137A, 137B, 137C and 137D, and rotatably supported.

Cleaning part 135 that removes the toner remained on the intermediate transfer body is disposed on the intermediate transfer body 131.

In the image forming apparatus 100, the photoreceptor 111Y, the developing part 117Y, the cleaning part 119Y, the lubricant removing part 114Y, the lubricant supplying part 116Y and the like may be integrally connected into a process cartridge (image forming unit) detachably mounted in the apparatus body. Alternatively, one or more members selected from the group consisting of the charging part 113Y, the exposure part 115Y, the developing part 117Y, the lubricant removing part 114Y, the lubricant supplying part 116Y, the primary transfer roller 133Y and the cleaning part 119Y may be integrally constituted with the photoreceptor 111Y to form a process cartridge (image forming unit).

Process cartridge 200 has housing 201, the photoreceptor 111Y, the charging part 113Y, the developing part 117Y, the lubricant supplying part 116Y, the cleaning part 119Y and the lubricant removing part 114Y stored in the housing 201, and the primary transfer roller 133Y. Also, in the apparatus body, support rails 203L and 203R are provided as part of guiding the process cartridge 200 into the apparatus body. This allows the process cartridge 200 to be detachable in the apparatus body. The process cartridge 200 can be a single image forming unit detachably mounted in the apparatus body.

Paper feeding and conveying part 150 is provided so that transferring material P in paper feeding cassette 211 can be carried to secondary transfer roller 217 through a plurality of intermediate rollers 213A, 213B, 213C and 213D and resist roller 215.

Fixing part 170 fixes the color image transferred by the secondary transfer roller 217. Paper discharge roller 219 is provided to sandwich the fixed transferring material P and to place it on paper discharge tray 221.

In the image forming apparatus 100 constituted as described above, the toner images are formed by the image forming units 110Y, 110M, 110C and 110Bk. Specifically, first, the lubricant is supplied on the surfaces of the photoreceptors 111Y, 111M, 111C and 111Bk by the lubricant supplying part 116Y, 116M, 116C and 116Bk. Thereafter, the charging part 113Y, 113M, 113C and 113Bk discharge to the surfaces of the photoreceptors 111Y, 111M, 111C and 111Bk to be negatively charged. Subsequently, the surfaces of the photoreceptors 111Y, 111M, 111C and 111Bk are exposed by exposure part 115Y, 115M, 115C and 115Bk based on the image signal to form an electrostatic latent image. Next, the toner is provided on the surfaces of the photoreceptors 111Y, 111M, 111C and 111Bk by developing part 117Y, 117M, 117C and 117Bk to form a toner image.

Subsequently, the primary transfer rollers (primary transfer part) 133Y, 133M, 133C and 133Bk are abutted on the rotating intermediate transfer body 131. Whereby, the toner images of each color each formed on the photoreceptors 111Y, 111M, 111C and 111Bk are sequentially transferred on the rotating intermediate transfer body 131 to transfer (primary transfer) a color image. During image forming processing, the primary transfer roller 133Bk is always in contact with the photoreceptor 111Bk. On the other hand, other primary transfer rollers 133Y, 133M and 133C are in contact with each corresponding photoreceptor 111Y, 111M or 111C, only when forming a color image.

Moreover, the primary transfer rollers 133Y, 133M, 133C and 133Bk are separated from the endless belt-shaped intermediate transfer body 131, then the toner remained on the surfaces of the photoreceptors 111Y, 111M, 111C and 111Bk are removed by cleaning part 119Y, 119M, 119C and 119Bk. Subsequently, the lubricant adhered on the surfaces of the photoreceptors 111Y, 111M, 111C and 111Bk is removed by the lubricant removing part 114Y, 114M, 114C and 114Bk. Thereafter, for next image forming process, the lubricant is supplied on the surfaces of the photoreceptors 111Y, 111M, 111C and 111Bk by the lubricant supplying part 116Y, 116M, 116C and 116Bk, and the surfaces of the photoreceptors 111Y, 111M, 111C and 111Bk are destaticized by a destaticization part (not illustrated) as necessary, then negatively charged by the charging part 113Y, 113M, 113C and 113Bk. As described above, the image forming apparatus 100 is constituted such that, in each image forming process, the lubricant with a charging history is removed after removing the toner on the surface of the photoreceptor 111, then new lubricant is supplied before being charged.

On the other hand, the transferring material P (e.g., a support carrying a final image such as plain paper and transparent sheet) stored in the paper feeding cassette 211 is fed by paper feeding and conveying part 150, and conveyed to the secondary transfer roller (secondary transfer part) 217 through a plurality of the intermediate rollers 213A, 213B, 213C and 213D and the resist roller 215. Moreover, the secondary transfer roller 217 is abutted on the rotating endless belt-shaped intermediate transfer body 131 to collectively transfer (secondarily transfer) the color images on the transferring material P. The secondary transfer roller 217 is in contact with the endless belt-shaped intermediate transfer body 131 only when secondary transfer is performed on the transferring material P. Thereafter, the transferring material P on which the color images are batch transferred is separated at a site where the curvature of the endless belt-shaped intermediate transfer body 131 is high.

The transferring material P on which the color images are batch transferred as described above is fixed by the fixing part 170, then placed on the paper discharge tray 221 on the outside of the apparatus, while being sandwiched with the paper discharge roller 219. In addition, the transferring material P on which the color images are batch transferred is separated from the intermediate transfer body 131, and then the toner remained on the intermediate transfer body 131 is removed by the cleaning part 135.

As described above, according to the image forming apparatus 100 of the present invention, new lubricant is supplied after removing lubricant having a charging history, thereby lubricant is supplied on the surface of the photoreceptor 111 by lubricant supplying part 116 and a film of the lubricant is formed before charging by charging part 113. Thus, degradation of the surface of the photoreceptor 111 can be prevented and resistance of the surface of the photoreceptor 111 can be kept high, therefore occurrence of image deletion in a high-temperature and high-humidity environment can be suppressed. Also, before removing the toner by cleaning part 119, since lubricant is present on the surface of the photoreceptor 111, good toner cleanability is obtained, and moreover, after removing the toner by the cleaning part 119, since the degraded lubricant is removed from the surface of the photoreceptor by lubricant removing part 114, occurrence of image deletion accompanying degradation of the lubricant can be suppressed.

[Toner]

The toner used in the image forming apparatus of the present invention is not particularly limited, but may be made of toner particles containing a binder resin and a colorant, and the toner particles may contain other components such as a release agent as desired.

The toner particles constituting the toner has a volume average particle size of preferably 2 to 8 μm, from the viewpoint of providing high image quality.

The method for producing the above toner is not particularly restricted, and examples include ordinary pulverization methods, wet melt-spheroidizing method for production in a dispersion medium, and known polymerization methods such as suspension polymerization, dispersion polymerization and emulsion polymerization and aggregation method, and the like.

Also, a proper amount of inorganic fine particles such as silica and titania with an average particle size of about 10 to 300 nm and about 0.2 to 3 μm abrasive as appropriate can be externally added to the toner particles as external additives.

The toner can be used as a magnetic or non-magnetic one-component developer and also may be mixed with a carrier and used as a two-component developer.

When the toner is used as a two-component developer, magnetic particles made of conventionally known material such as a ferromagnetic metal such as iron, an alloy of a ferromagnetic metal and aluminum, lead or the like and a ferromagnetic metal compound such as ferrite and magnetite can be used, and ferrite is particularly preferred.

EXAMPLES

The present invention will be described in detail with reference to examples but the present invention is not limited only to the following examples. Here, "part(s)" represents "part(s) by mass".

Preparation Example 1 of Photoreceptor

The surface of an aluminum cylinder of 60 mm in diameter was machined to prepare a conductive support [1] having a finely roughed surface.

(Formation of Intermediate Layer)

The dispersion liquid of the following composition was diluted twice with the same solvent as the following solvent, and filtered after standing still overnight (using a filter; Rigimesh 5 μm filter manufactured by Pall Corporation) to prepare a coating liquid [1] for forming an intermediate layer.

Binder resin: Polyamide resin "CM8000" (manufactured by Toray Industries, Inc.) 1 part Metal oxide particles: Titanium oxide "SMT500SAS" (manufactured by TAYCA CORPORATION) 3 parts Solvent: Methanol 10 parts Dispersion was performed for 10 hours in a batch, using a sand mill as a disperser.

The coating liquid [1] for forming an intermediate layer was applied on the conductive support [1] by a dip coating method, to form an intermediate layer [1] with a dry film in thickness of 2 μm.

(Formation of Charge Generating Layer)

20 parts of charge generating substance of the following pigment (CG-1), 10 parts of binder resin of polyvinyl butyral resin "#6000-C" (manufactured by DENKI KAGAKU KOGYO KABUSHIKI KAISHA), 700 parts of solvent of t-butyl acetate, and 300 parts of solvent of 4-methoxy-4-methyl-2-pentanone were mixed and then dispersed using a sand mill for 10 hours to prepare a coating liquid [1] for forming a charge generating layer. The coating liquid [1] for forming a charge generating layer was applied on the intermediate layer [1], by a dip coating method, to form a charge generating layer [1] with a dry film thickness of 0.3 μm.

<Synthesis of Pigment (CG-1)>

(1) Synthesis of Amorphous Titanyl Phthalocyanine 29.2 parts of 1,3-diiminoisoindoline was dispersed in 200 parts of o-dichlorobenzene, and 20.4 parts of titanium tetra-n-butoxide was added, then the mixture was heated under a nitrogen atmosphere at 150 to 160° C. for 5 hours. After cooling, the precipitated crystal was filtered, washed with chloroform, washed with a 2% aqueous hydrochloric acid solution, washed with water and methanol and dried to obtain 26.2 parts (yield of 91%) of crude titanyl phthalocyanine.

Subsequently, the crude titanyl phthalocyanine was stirred to dissolve in 250 parts of concentrated sulfuric acid at 5° C. or lower for 1 hour, and the solution was poured into 5000 parts of water at 20° C. The precipitated crystal was filtered and sufficiently washed with water to obtain 225 parts of a wet paste product.

The wet paste product was frozen in a freezer, and thawed again, then filtered and dried to obtain 24.8 parts (yield of 86%) of amorphous titanyl phthalocyanine.

(2) Synthesis of (2R,3R)-2,3-Butanediol Adduct Titanyl Phthalocyanine (CG-1)

10.0 parts of the amorphous titanyl phthalocyanine and 0.94 parts of (2R,3R)-2,3-butanediol (0.6 equivalence ratio) (the equivalence ratio is an equivalence ratio to titanyl phthalocyanine, and so on) were mixed in 200 parts of o-dichlorobenzene (ODB) and heated and stirred at 60 to 70° C. for 6.0 hours. After being left overnight, the crystal generated by adding methanol to the reaction solution was filtered, and the filtered crystal was washed with methanol to obtain 10.3 parts of CG-1 (pigment containing (2R,3R)-2,3-butanediol adduct titanyl phthalocyanine). In the X-ray diffraction spectrum of the pigment (CG-1), there are clear peaks at 8.3°, 24.7°, 25.1° and 26.5°. There are peaks at 576 and 648 in the mass spectrum, and absorptions of Ti═O appears around 970 $cm^{-1}$ and O—Ti—O appears 630 $cm^{-1}$, respectively, in the IR spectrum. Also, in thermal analysis (TG), there is about 7% of mass reduction at 390 to 410° C. Thus, the pigment was assumed as a mixture of a 1:1 adduct of titanyl phthalocyanine and (2R,3R)-2,3-butanediol and a non-adduct (not added) titanyl phthalocyanine.

The BET specific surface area of the resulting pigment (CG-1) measured by a flow type specific surface area automatic measuring apparatus (Micrometrics Flow Sorb: Shimadzu Corporation) was 31.2 $m^2/g$.

(Formation of Charge Transport Layer)

225 parts of charge transport substance of the following compound A, 300 parts of binder resin of polycarbonate resin "Z300" (manufactured by MITSUBISHI GAS CHEMICAL COMPANY, INC.), 6 parts of antioxidant "Irganox1010" (manufactured by Nihon Ciba-Geigy K.K.), 1600 parts of solvent of THF (tetrahydrofuran), 400 parts of solvent of toluene and 1 part of silicone oil "KF-50" (manufactured by Shin-Etsu Chemical Co., Ltd.) were mixed and dissolved to prepare a coating liquid [1] for forming a charge transfer layer.

The coating liquid [1] for forming a charge transfer layer was applied on the charge generating layer [1], using a circular slide hopper coating apparatus, to form a charge transfer layer [1] with a dry film thickness of 20 μm.

[Chemical Formula 3]

Compound A

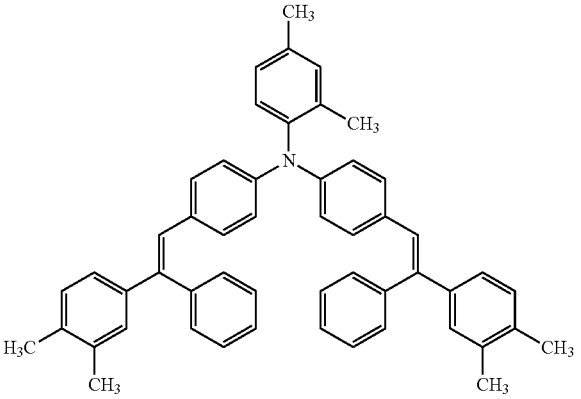

(Formation of Protective Layer)

(1) Preparation of Metal Oxide Fine Particles

A mixed solution of 100 parts of tin oxide (manufactured by CIK NanoTek Corporation, number average primary particle size: 20 nm), 30 parts of the exemplified compound (S-13) as a surface treatment agent and 300 parts of a mixed solvent of toluene/isopropyl alcohol=1/1 (mass ratio) was put in a sand mill with zirconia beads, and stirred at a rotation speed of 1500 rpm at about 40° C. Furthermore, the above treated mixture was taken out and introduced into a Henschel mixer and stirred at a rotation speed of 1500 rpm for 15 minutes, then dried at 120° C. for 3 hours, thereby terminating surface treatment of tin oxide with the compound having a radically polymerizable functional group to obtain surface-treated tin oxide. This surface-treated tin oxide is referred to metal oxide fine particles [1]. The particle surface of tin oxide was coated with the exemplified compound (S-13) by the surface treatment with the compound having a radically polymerizable functional group.

(2) Formation of Protective Layer 100 parts of the metal oxide fine particles [1], 100 parts of a polymerizable compound of the exemplified compound (M1), 320 parts of a solvent of sec-butanol and 80 parts of a solvent of THF (tetrahydrofuran) were mixed under shaded conditions, and dispersed for 5 hours using a sand mill as a disperser. Thereafter, 10 parts of a polymerization initiator: "Irgacure" (manufactured by BASF Japan Ltd.) was added thereto, and the mixture was stirred to dissolve under shaded conditions to prepare a coating liquid [1] for forming a protective layer. The coating liquid [1] for forming a protective layer was applied on the charge transfer layer [1], using a circular slide hopper coating apparatus, to form a coating film. Thereafter, this coating film was dried at room temperature for 15 minutes, and in a nitrogen stream, using a xenon lamp, the separation distance between a light source and the coating film was set to 10 mm, and the coating film was irradiated with ultraviolet light with a lamp output of 1 kW for 1 minute to form a protective layer [1] with a dry thickness of 3.0 μm to prepare a photoreceptor [1]. The universal hardness of the protective layer in the photoreceptor [1] was 200 $N/mm^2$.

Preparation Example 2 of Photoreceptor

The same procedures as in the formation of the protective layer of Preparation Example 1 of the photoreceptor were carried out, except for changing the exemplified compound (M1) to the exemplified compound (M2) as a polymerizable compound, to prepare a photoreceptor (2). The universal hardness of the protective layer in the photoreceptor [2] was 300 $N/mm^2$.

Preparation Example 3 of Photoreceptor

The same procedures as in the formation of the protective layer of Preparation Example 1 of the photoreceptor were carried out, except for changing the exemplified compound (M1) to the exemplified compound (M11) as a polymerizable compound, to prepare a photoreceptor [3]. The universal hardness of the protective layer in the photoreceptor [3] was 550 $N/mm^2$.

Example 1

The photoreceptor [1] was mounted on an image forming apparatus "bizhub C353" (manufactured by Konica Minolta Inc.), and the image forming unit was modified such that charging was performed by a charging roller. Also, the lubricant removing part of the following specification was installed on the downstream of the cleaning part, and the lubricant supplying part of the following specification was disposed on the downstream of the lubricant removing part and the upstream of the charging part. Specifically, the image forming unit was modified so as to have the disposition depicted in FIG. 2. The following evaluation was performed using this evaluation machine. The result is depicted in Table 1.

—Specifications of Lubricant Removing Part—

For the lubricant removing part, a removing member containing a straight type brush roller was used. This brush roller used carbon-containing nylon fiber "SA-7" (manufactured by Toray Industries, Inc.) as a filament yarn, and was formed by spirally winding a ribbon-like fabric of a brush fiber having a thickness of 10 denier, a planting density of a brush fiber of 75 $kF/inch^2$ and a length of a brush fiber of 3.0 mm around a metal shaft (SUM22) with an external diameter of 6 mm. Also, the brush roller was installed so as to have a biting amount of 0.8 mm into the photoreceptor, and rotated at a peripheral speed ratio of 0.6 in a opposite direction to the rotation direction of the photoreceptor. In addition, the brush roller was grounded via the metal shaft.

—Specifications of Lubricant Supplying Part—

As the lubricant supplying part, a device constituted by a lubricant stock and a coating member containing a straight type brush roller, as depicted in FIG. 2, was used. This brush roller used carbon-containing nylon fiber "SA-7" (manufactured by Toray Industries, Inc.) as a filament yarn, and was formed by spirally winding a ribbon-like fabric of a brush fiber having a thickness of 3 denier, a planting density of a brush fiber of 120 $kF/inch^2$ and a length of a brush fiber of 3.0 mm, around a metal shaft (SUM22) with an external diameter of 6 mm. Also, the brush roller was installed so as to have a biting amount of 1 mm into the photoreceptor, and rotated at a peripheral speed ratio of 0.6 in an opposite direction to the rotation direction of the photoreceptor. In addition, the brush roller was grounded via the metal shaft. The pressing force of the lubricant stock to the brush roller was set to 2 N/m. The type of the lubricant was zinc stearate.

In this evaluation apparatus, the lubricant abundance ratio A per unit area of the surface of the photoreceptor after supplying lubricant by the lubricant supplying part and before charging by the charging part was 2.05 (atom %), and the lubricant abundance ratio B per unit area of the surface of the photoreceptor after removing the lubricant by the lubricant removing part and before supplying lubricant by the lubricant supplying part was 0.25 (atom %). Zinc, tin, silicone, carbon, oxygen and nitrogen were quantitatively analyzed as selected elements, using an X-ray photoelectron spectrometer "K-Alpha" (manufactured by Thermo Fisher Scientific Inc.) In the measurement of the lubricant abundance ratio, and the measured amount of zinc was used as the substitution amount. Hereinafter, the lubricant abundance ratios in Examples 2 to 4 and Comparative Example 1 were measured in the same manner.

(1) Evaluation of Image Deletion 2,000 sheets of letter charts corresponding to a printing rate of 5% were continuously printed in a high-temperature and high-humidity environment (temperature of 30° C., a humidity of 85% RH), then the apparatus was turned off and left for 8 hours. Thereafter, the apparatus was turned on, and 20 sheets of A3 half-tone images were continuously printed.

Image deletion was evaluated by the number of sheets when the half-tone image was recovered to the level before leaving the apparatus. When recovered within the first sheet, it was evaluated as "A", when recovered within the third sheet, it was evaluated as "B", when recovered within the seventh sheet, it was evaluated as "C", when recovered within the twentieth sheet, it was evaluated as "D", and when recovered at the twenty first sheet or later, it was evaluated as "E". Those recovered within the twentieth sheet are considered as passing.

(2) Evaluation of Abrasion Amount of Photoreceptor 100,000 sheets of letter charts corresponding to a printing rate of 5% were printed in a high-temperature and high-humidity environment (temperature of 25° C., a humidity of 50% RH), then the film thickness of the protective layer of the photoreceptor was measured. For the measurement of the film thickness, a film thickness measuring device "Fischer scope MMS PC" (manufactured by Fischer Instruments) was used. When the abrasion amount of the protective layer is 0.3 μm or less, it was evaluated as "A", when more than 0.3 μm and 0.6 μm or less, it was evaluated as "B", when more than 0.6 μm and 1.0 μm or less, it was evaluated as "C", and when more than 1.0 μm, it was evaluated as "D".

(3) Evaluation of Toner Cleanability

Toner cleanability was checked in a low-temperature and low-humidity environment (temperature of 10° C., a humidity of 15% RH), using the photoreceptor after the evaluation of the abrasion amount (2) described above and a cleaning blade. As for measurement of cleanability, using an external driver of an image forming apparatus "bizhub C6500" base, a photoreceptor unit with a cleaning blade set at an abutting linear pressure of 15 N/m and an effective abutting angle of 11° was prepared, and the entire surface band of a toner amount of 1 g/m$^2$ was output on one round of the photoreceptor (94 mm) in a driving state, then the cleanability was judged by the presence or absence of the occurrence of wiping residue of the toner after the band passed through one round of the cleaning blade. When wiping residue was not found in the entire surface, it was evaluated as "A", when wiping residue was caused only in the blade chipping part, it was evaluated as "B", and when wiping residue was caused on the surface, it was evaluated as "C".

Example 2

The same procedures were carried out as in Example 1, except for changing the photoreceptor [1] to the photoreceptor [2], and setting the biting amount of the brush roller into the photoreceptor in the lubricant removing part to 1.0 mm, and the above evaluations were performed.

Example 3

The same procedures were carried out as in Example 1, except for setting the biting amount of the brush roller into the photoreceptor in the lubricant removing part to 0.5 mm, and the above evaluations were performed.

Example 4

The same procedures were carried out as in Example 1, except for changing the photoreceptor [1] to the photoreceptor [3], and setting the biting amount of the brush roller into the photoreceptor in the lubricant removing part to 1.2 mm, and the above evaluations were performed.

Comparative Example 1

Figure 4:
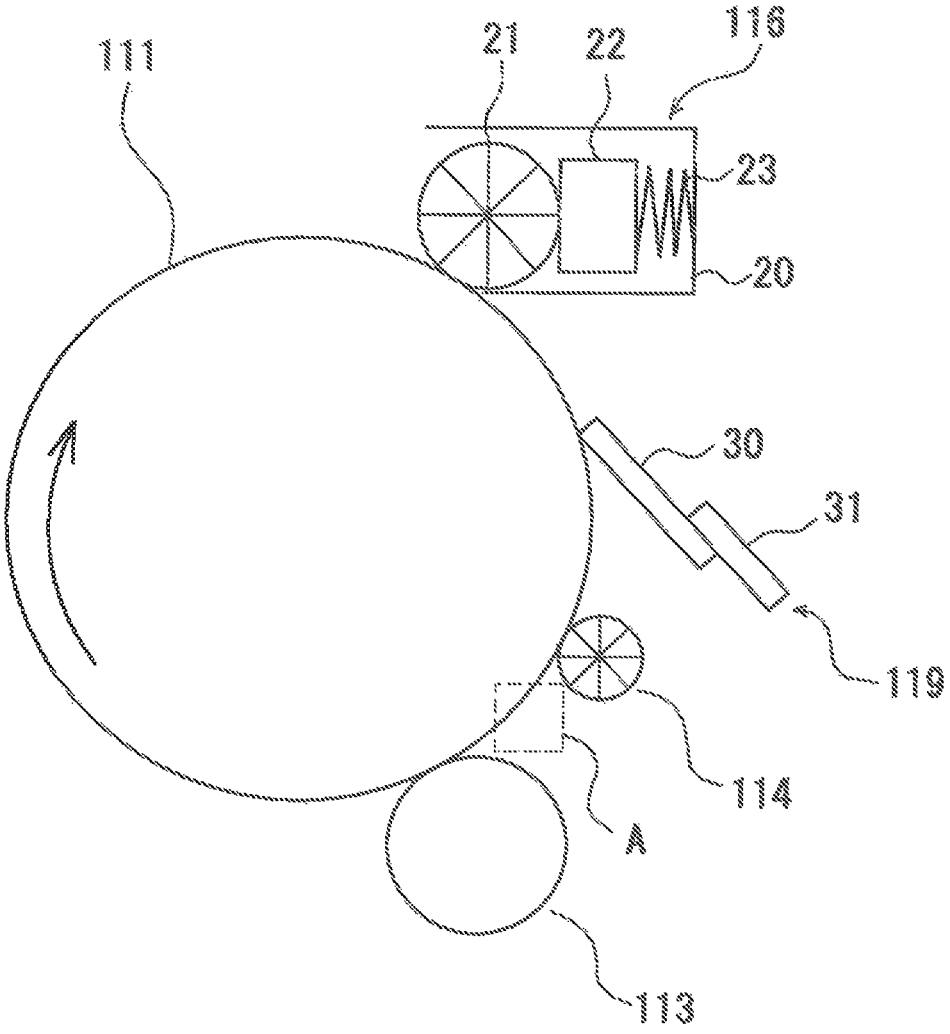
FIG. 4 is an explanatory sectional view of a constitution of a main part of the image forming apparatus used in Comparative Example 1.

The same procedures were carried out as in Example 1, except that it is deposed as depicted in FIG. 4, specifically, lubricant supplying part (116) was disposed on the upstream of cleaning part (119), and lubricant removing part (114) was disposed on the downstream of the cleaning part (119) and the upstream of the charging part (113), the biting amount of the brush roller into the photoreceptor in the lubricant removing part was set to 0.25 mm, and the brush roller was rotated at a peripheral speed ratio of 1.2 in the same direction as the rotation direction of the photoreceptor, and the above evaluations were performed.

In this constitution, the lubricant abundance ratio A depicted in Table 1, as depicted in FIG. 4, shows a lubricant abundance ratio per unit area of the surface of the photoreceptor after removing the lubricant by the lubricant removing part (114) and before charging by the charging part (113).

TABLE 1

| | | Lubricant Abundance Ratio | | | Universal | Image Deletion | | Abrasion Resistance | | |
|---|---|---|---|---|---|---|---|---|---|---|
| | Photoreceptor No. | A/B | A (atm %) | B (atm %) | Hardness (N/mm↑2↑) | Number of Sheet | Rank | Abrasion Amount (μm) | Rank | Cleanability |
| Example 1 | [1] | 8.2 | 2.05 | 0.25 | 200 | 7 | C | 0.5 | B | A |
| Example 2 | [2] | 12.8 | 1.92 | 0.15 | 300 | 3 | B | 0.4 | B | A |
| Example 3 | [1] | 4.9 | 1.88 | 0.38 | 200 | 15 | D | 0.6 | B | A |
| Example 4 | [3] | 26.9 | 2.15 | 0.08 | 550 | 1 | A | 0.1 | A | A |
| Comparative Example 1 | [1] | — | 0.62 | — | 200 | 21 | E | 0.5 | B | B |

Based on the result of Table 1, according to Examples 1 to 4 in the present invention, it was confirmed that, while maintaining high abrasion resistance, occurrence of image deletion in a high-temperature and high-humidity environment can be suppressed, and good toner cleanability is obtained. It is considered that the reason why occurrence of image deletion is suppressed is that lubricant is supplied on the surface of the photoreceptor by a lubricant supplying part to form a film of the lubricant before charging by charging part, thus degradation of the surface of the photoreceptor is prevented, and also that, after removing the toner by cleaning part, the degraded lubricant is removed from the surface of the photoreceptor by a lubricant removing part. In addition, it is considered that the reason why cleanability is obtained is that, before removing the toner by cleaning part, the lubricant is sufficiently present on the surface of the photoreceptor.

On the other hand, in Comparative Example 1, it was confirmed that occurrence of image deletion cannot be sufficiently suppressed in a high-temperature and high-humidity environment. It is considered that this is because, before charging by charging part, the lubricant is removed from the surface of the photoreceptor by a lubricant removing part, and degradation of the surface of the photoreceptor cannot be suppressed.

The invention claimed is:

1. An image forming apparatus comprising:

a photoreceptor having a protective layer containing a crosslinked polymer as a surface layer;

a lubricant supplying part that supplies lubricant onto the surface of the photoreceptor, a charging part that charges the surface of the photoreceptor by a charging roller, an exposure part that exposes the charged photoreceptor by the charging part, a developing part that supplies toner to the exposed photoreceptor by the exposure part to form a toner image, a transfer part that transfers the toner image formed on the photoreceptor, a cleaning part that removes the toner remained on the surface of the photoreceptor and a lubricant removing part that removes the lubricant adhered on the surface of the photoreceptor; and wherein, the lubricant supplying part, the charging part, the exposure part, the developing part, the transfer part, the cleaning part and the lubricant removing part are sequentially disposed along with a rotation direction of the photoreceptor in an external area of the rotating photoreceptor, and wherein the lubricant removing part is disposed downstream of the cleaning part and upstream of the lubricant supplying part in the rotation direction of the photoreceptor.

2. The image forming apparatus according to claim 1, wherein, when a lubricant abundance ratio per unit area of the surface of the photoreceptor after supplying lubricant by the lubricant supplying part and before charging by the charging part is referred to A (atm %) and a lubricant abundance ratio per unit area of the surface of the photoreceptor after removing the lubricant by the lubricant removing part and before supplying lubricant by the lubricant supplying part is referred to B (atm %), $A \geq 8B$ and $A \geq 1.7$ are satisfied.

3. The image forming apparatus according to claim 2, wherein the lubricant abundance ratio A is 2.0 to 2.5 atm %.

4. The image forming apparatus according to claim 2, wherein a ratio of the lubricant abundance ratio A to the lubricant abundance ratio B, A/B is 20 to 30.

5. The image forming apparatus according to claim 1, wherein the protective layer in the photoreceptor has a universal hardness of 280 $N/mm^2$ or more and 600 $N/mm^2$ or less.

6. The image forming apparatus according to claim 1, wherein the lubricant is zinc stearate.

7. The image forming apparatus according to claim 1, wherein the lubricant removing part is a brush roller or a foamed roller.

8. The image forming apparatus according to claim 7, wherein the lubricant removing part is a brush roller.

* * * * *